US010157575B2

(12) United States Patent
So et al.

(10) Patent No.: US 10,157,575 B2
(45) Date of Patent: Dec. 18, 2018

(54) DISPLAY DEVICE AND ELECTRONIC DEVICE HAVING THE SAME

(71) Applicant: Samsung Display Co., Ltd., Yongin-si, Gyeonggi-Do (KR)

(72) Inventors: Yong-Sub So, Suwon-si (KR); Byung-Hyuk Shin, Seoul (KR); Myeong-Bin Lim, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 5 days.

(21) Appl. No.: 15/413,939

(22) Filed: Jan. 24, 2017

(65) Prior Publication Data

US 2017/0270864 A1 Sep. 21, 2017

(30) Foreign Application Priority Data

Mar. 16, 2016 (KR) ..... 10-2016-0031244

(51) Int. Cl.
*G09G 3/3258* (2016.01)
*G09G 3/3291* (2016.01)
*G09G 3/3233* (2016.01)

(52) U.S. Cl.
CPC ..... *G09G 3/3258* (2013.01); *G09G 3/3233* (2013.01); *G09G 3/3291* (2013.01); *G09G 2310/0243* (2013.01); *G09G 2310/0251* (2013.01); *G09G 2310/0291* (2013.01); *G09G 2310/08* (2013.01); *G09G 2330/04* (2013.01); *G09G 2370/08* (2013.01)

(58) Field of Classification Search
CPC ..... G09G 3/3258; G09G 3/3291; G09G 3/3233; G09G 2310/0251; G09G 2310/0243; G09G 2310/08; G09G 2310/0291; G09G 2330/04; G09G 2370/08
See application file for complete search history.

(56) References Cited

U.S. PATENT DOCUMENTS

2003/0179164 A1* 9/2003 Shin ..... G09G 3/3233 345/76
2006/0151745 A1* 7/2006 Kim ..... G09G 3/325 252/301.16
2007/0182667 A1 8/2007 Choi
(Continued)

FOREIGN PATENT DOCUMENTS

EP 1347436 A2 9/2003

OTHER PUBLICATIONS

European Search Report for Application No. 17160874.8, dated Aug. 29, 2017, pp. 1-14.

*Primary Examiner* — David Tung
(74) *Attorney, Agent, or Firm* — Innovation Counsel LLP

(57) ABSTRACT

A display device includes a display panel including data lines, scan lines, and pixels, a scan driver configured to provide a scan signal to the pixels through the scan lines, a data driver configured to provide data signal to the pixels through the data lines, a voltage generator configured to provide an on-bias voltage to the pixels through the data lines, a timing controller configured to generate a first control signal that controls the data driver and a second control signal that controls the voltage generator, and a protection circuit configured to generate a first protection signal and a second protection signal and prevent an overlapping output of the data signal and the on-bias voltage based on the first control signal and the second control signal.

20 Claims, 7 Drawing Sheets

(56) References Cited

U.S. PATENT DOCUMENTS

| | | | | |
|---|---|---|---|---|
| 2008/0158129 | A1 | 7/2008 | Murakami et al. | |
| 2012/0098813 | A1 | 4/2012 | Park et al. | |
| 2013/0127806 | A1* | 5/2013 | Wu | G09G 3/3688 345/211 |
| 2013/0215092 | A1 | 8/2013 | Wu et al. | |
| 2013/0285997 | A1 | 10/2013 | Shin et al. | |
| 2014/0139505 | A1 | 5/2014 | Han | |

* cited by examiner

| CTL1 | CTL2 | T1 | T2 |
|---|---|---|---|
| LOW | LOW | OFF | ON |
| LOW | HIGH | ON | OFF |
| HIGH | LOW | OFF | ON |
| HIGH | HIGH | OFF | OFF |

| CTL1 | CTL2 | T1 | T2 |
|---|---|---|---|
| LOW | LOW | ON | OFF |
| LOW | HIGH | ON | OFF |
| HIGH | LOW | OFF | ON |
| HIGH | HIGH | OFF | OFF |

| CTL1 | CTL2 | T1 | T2 |
|---|---|---|---|
| LOW | LOW | OFF | OFF |
| LOW | HIGH | ON | OFF |
| HIGH | LOW | OFF | ON |
| HIGH | HIGH | OFF | OFF |

DISPLAY DEVICE AND ELECTRONIC DEVICE HAVING THE SAME

CROSS-REFERENCE TO RELATED APPLICATION(S)

This application claims priority under 35 USC § 119 to Korean Patent Application No. 10-2016-0031244, filed on Mar. 16, 2016 in the Korean Intellectual Property Office (KIPO), the contents of which are incorporated herein in its entirety by reference.

BACKGROUND

1. Technical Field

Example embodiments relate generally to a display device and an electronic device having the same. More particularly, embodiments of the present inventive concept relate to a pixel and a display device having the same.

2. Description of the Related Art

Flat panel display (FPD) devices are widely used as a display device of electronic devices because FPD devices are relatively lightweight and thin compared to cathode-ray tube (CRT) display devices. Examples of FPD devices are liquid crystal display (LCD) devices, field emission display (FED) devices, plasma display panel (PDP) devices, and organic light emitting display (OLED) devices. OLED devices have become popular due to their various advantages, such as a wide viewing angle, a rapid response speed, a thin thickness, low power consumption, etc.

A plurality of data lines and a plurality of scan lines may be formed on a display panel of the organic light emitting display device. A plurality of pixels may be formed in intersection regions of the data lines and the scan lines. A data voltage of an on-bias voltage may be provided to each of the pixels through the data lines when the organic light emitting display device is driven with a simultaneous emission with active voltage (SEAV) method. However, a pixel of the display panel may be damaged if the data voltage and the on bias voltage are simultaneously provided.

SUMMARY

Some example embodiments provide a display device capable of preventing a data voltage and an on-bias voltage from being simultaneously provided to a pixel when the display device is driven with a simultaneous emission with active voltage (SEAV) method.

Some example embodiments provide an electronic device capable of including a display device that prevents a data voltage and an on-bias voltage from being simultaneously provided to a pixel when the display device is driven with a simultaneous emission with active voltage (SEAV) method.

According to an aspect of example embodiments, a display device may include a display panel including a plurality of data lines, a plurality of scan lines, and a plurality of pixels, a scan driver configured to provide a scan signal to the pixels through the scan lines, a data driver configured to provide a data signal to the pixels through the data lines, a voltage generator configured to provide an on-bias voltage to the pixels through the data lines, a timing controller configured to generate a first control signal that controls the data driver and a second control signal that controls the voltage generator, and a protection circuit configured to generate a first protection signal and a second protection signal and prevent an overlapping output of the data signal and the on-bias voltage based on the first control signal and the second control signal.

In example embodiments, the data driver may include a first switching transistor that turns on or turns off in response to the first protection signal.

In example embodiments, the pixel may include a second switching transistor that turns on or turns off in response to the second protection signal.

In example embodiments, the protection circuit may include an inverter configured to invert the second control signal and an OR gate configured to implement a logical sum of the first control signal and an output signal of the inverter.

In example embodiments, the protection circuit may include an inverter configured to invert the first control signal and an OR gate configured to implement a logical sum of an output signal of the inverter and the second control signal.

In example embodiments, the protection circuit may include a first inverter configured to invert the second control signal, a second inverter configured to reverse the first control signal, a first OR gate configured to implement a logical sum of the first control signal and an output signal of the first inverter, and a second OR gate configured to implement a logical sum of the second control signal and an output signal of the second inverter.

In example embodiments, the display device may further include a first level shifter configured to amplify the first protection signal and a second level shifter configured to amplify the second protection signal.

In example embodiments, the protection circuit may be included in the first level shifter or the second level shifter.

In example embodiments, the protection circuit may be included in the data driver.

In example embodiments, the protection circuit may further include a delay element that delays the first protection signal or the second protection signal.

According to an aspect of example embodiments, an electronic device may include a display device and a processor that controls the display device. The display device may include a display panel including a plurality of data lines, a plurality of scan lines, and a plurality of pixels, a scan driver configured to provide a scan signal to the pixels through the scan lines, a data driver configured to provide a data signal to the pixels through the data lines, a voltage generator configured to provide an on-bias voltage to the pixels through the data lines, a timing controller configured to generate a first control signal that controls the data driver and a second control signal that controls the voltage generator, and a protection circuit configured to generate a first protection signal and a second protection signal and prevent an overlapping output of the data signal and the on-bias voltage based on the first control signal and the second control signal.

In example embodiments, the data driver may include a first switching transistor that turns on or turns off in response to the first protection signal.

In example embodiments, the pixel may include a second switching transistor that turns on or turns off in response to the second protection signal.

In example embodiments, the protection circuit may include an inverter configured to invert the second control signal and an OR gate configured to implement a logical sum of the first control signal and an output signal of the inverter.

In example embodiments, the protection circuit may include an inverter configured to invert the first control signal and an OR gate configured to implement a logical sum of an output signal of the inverter and the second control signal.

In example embodiments, the protection circuit may include a first inverter configured to invert the second control signal, a second inverter configured to invert the first control signal, a first OR gate configured to implement a logical sum of the first control signal and an output signal of the first inverter, and a second OR gate configured to implement a logical sum of the second control signal and an output signal of the second inverter.

In example embodiments, the display device may further include a first level shifter configured to amplify the first protection signal and a second level shifter configured to amplify the second protection signal.

In example embodiments, the protection circuit may be included in the first level shifter or the second level shifter.

In example embodiments, the protection circuit may be included in the data driver.

In example embodiments, the protection circuit may further include a delay element that delays the first protection signal or the second protection signal.

Therefore, a display device and an electronic device may prevent the data signal and the on bias voltage from being simultaneously provided to the pixels in the display panel through the data line due to a static electricity or a noise defect by including a protection circuit coupled to the data driver and the pixel. Thus, the defect of the display device may be prevented.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF THE EMBODIMENTS

Hereinafter, the present inventive concept is explained in detail with reference to the accompanying drawings.

Figure 1:
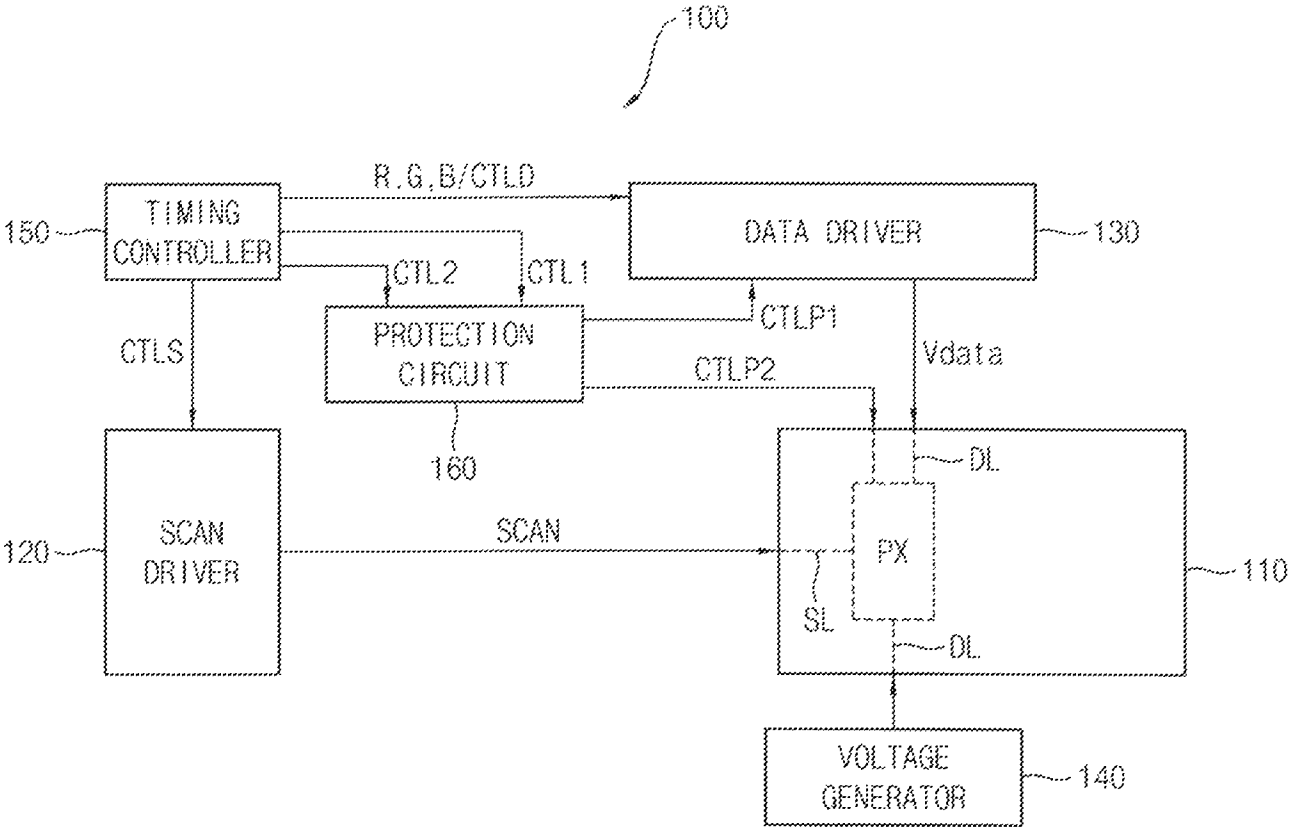
FIG. 1 is a block diagram illustrating a display device according to example embodiments.

FIG. 1 is a block diagram illustrating a display device according to example embodiments.

Referring to FIG. 1, a display device 100 may include a display panel 110, a scan driver 120, a data driver 130, a voltage generator 140, a timing controller 150, and a protection circuit 160.

A plurality of scan lines SL and a plurality of data lines DL may be formed on the display panel 110. A plurality of pixels PX may be formed in intersection regions of the scan lines SL and the data lines DL. Each of the pixels PX may include switching transistors, a driving transistor, an organic light emitting diode and capacitors.

When the display device 100 is driven with a simultaneous emission with active voltage (SEAV) method, a data signal Vdata or an on-bias voltage Von may be provided to a pixel PX through a data line DL according to an operation period of the pixel PX. Specifically, the data signal Vdata may be provided to the pixel PX through the data line DL during a scan period. Further, the on bias-voltage Von may be provided to the pixel PX through the data line DL during an on-bias period. Here, the driving transistor may turn on during the on-bias period. Each of the pixels PX may include a second switching transistor that turns on or turns off in response to a second protection signal CTLP2 provided from the protection circuit 160. When the second switching transistor is turned on, the on-bias voltage Von may be provided to the pixel PX through the data line DL during the on-bias period. When the second switching transistor is turned off, the on-bias voltage Von may not be provided to the pixel PX during the scan period.

The scan driver 120 may provide a scan signal SCAN to the pixels PX through the scan lines. The san driver 120 may generate the scan signal SCAN based on a scan control signal CTLS provided from the timing controller 150.

The data driver 130 may provide the data signal Vdata to the pixels PX through the data lines DL. The data driver 130 may generate the data signal Vdata based on an image data R, G, B and a data control signal CTLD provided from the timing controller 150. The data driver may include a first switching transistor that turns on or turns off in response to a first protection signal CTLP1 provided from the protection circuit 160. When the first switching transistor is turned on, the data signal Vdata may be provided to the pixel PX through the data line DL during the scan period. When the first switching transistor is turned off, the data signal Vdata may not be provided to the pixel PX during the on-bias period.

The voltage generator 140 may provide the on-bias voltage Von to the pixel through the data lines DL. The on-bias voltage Von may have a voltage level that turns on the driving transistor included in the pixel PX. The voltage generator 140 may be coupled to the second switching transistor of the pixel PX. The voltage generator 140 may provide the on-bias voltage Von to the pixel PX through the second switching transistor when the second switching transistor turns on. The voltage generator 140 may provide a high power voltage and a low power voltage to drive the pixel PX, although not illustrated in FIG. 1.

The timing controller 150 may generate a first control signal CTL1 that controls an output of the data driver 130 and a second control signal CTL2 that controls an output of the voltage generator 140. The first control signal CTL1 and the second control signal CTL2 generated in the timing controller 150 may be provided to the protection circuit 160. Further, the timing controller 150 may generate the data control signal CTLD that controls the data driver 130 and may provide the image data R, G, B and the data control signal CTLD to the data driver 130.

The protection circuit 160 may prevent an overlapping output of the data signal Vdata and the on-bias voltage Von. The protection circuit 160 may receive the first control signal CTL1 and the second control signal CTL2 from the timing controller 150. The protection circuit 160 may convert the first control signal CTL1 to a first protection signal CTLP1 and convert the second control signal CTL2 to a second protection signal CTLP2. The first switching transistor of the data driver 130 may turn on or turn off in response to the first protection signal CTLP1 provided from the protection circuit 160. The data signal Vdata may be provided to the pixel PX through the data line DL when the first switching transistor in the data driver 130 turns on in response to the first protection signal CTLP1. The second switching transistor of the pixel PX may turn on or turn off in response to the second protection signal CTLP2 provided from the protection circuit 160. The on-bias voltage Von may be provided to the pixel PX through the data line DL when the second switching transistor turns on in response to the second protection signal CTLP2. The protection circuit 160 may convert one of the first control signal CTL1 or the second control signal CTL2 when the first control signal CTL1 and the second control signal CTL2 simultaneously turn on the first switching transistor in the data driver 130 and the second switching transistor in the pixel PX. That is, the protection circuit 160 may prevent the first switching transistor and the second switching transistor from being simultaneously turned on by converting the first control signal CTL1 and the second control signal CTL2 to the first protection signal CTLP1 and the second protection signal CTLP2. In some example embodiments, the first switching transistor and the second switching transistor may be implemented as a p-channel metal oxide semiconductor (PMOS) transistor. In such cases, the first switching transistor and the second switching transistor may turn on in response to a signal having a low level (e.g., 0V). In other example embodiments, the first switching transistor and the second switching transistor may be implemented as an n-channel metal oxide semiconductor (NMOS) transistor. In such cases, the first switching transistor and the second switching transistor may turn on in response to a signal having a high level (e.g. 12V).

In some example embodiments, the protection circuit 160 may include an inverter that inverts the second control signal CTL2 and an OR gate that conducts a logical sum of the first control signal CTL1 and an output signal of the inverter. In such cases, the protection circuit 160 may further include a delay element that delays the first protection signal CTLP1. In other example embodiments, the protection circuit 160 may include an inverter that inverts the second control signal CTL2 and an OR gate that conducts a logical sum of the first control signal CTL1 and an output signal of the inverter. In such cases, the protection circuit 160 may further include a delay element that delays the second protection signal CTLP2. In other example embodiments, the protection circuit 160 may include a first inverter that inverts the second control signal CTL2, a second inverter that inverts the first control signal CTL1, a first OR gate that conducts a logical sum of the first control signal CTL1 and an output signal of the first inverter, and a second OR gate that conducts a logical sum of the second control signal CTL2 and an output signal of the second inverter. The protection circuit 160 may be coupled to the data driver 130. The protection circuit 160 may be located in the data driver 130.

The display device may further include a first level shifter and a second level shifter. The first level shifter may amplify the first protection signal CTLP1. The first protection signal CTLP1 may have a voltage level that turns on the first switching transistor of the data driver 130. The second level shifter may amplify the second protection signal CTLP2. The second protection signal CTLP2 may have a voltage level that turns on the second switching transistor of the pixel PX. The protection circuit 160 may be included in the first level shifter or the second level shifter.

As described above, the display device 100 may include a protection circuit 160 that prevents the overlapping output of the on-bias voltage Von and the data signal Vdata to the data line DL of the pixel PX. The protection circuit 160 may prevent the first switching transistor and the second switching transistor from simultaneously turning on by converting the first control signal CTL1 and the second control signal CTL2 into the first protection signal CTLP1 and the second protection signal CTLP2. Thus, a damage of the display panel 110 that occurs by simultaneously providing the on-bias voltage Von and the data signal Vdata may be prevented.

Figure 2:
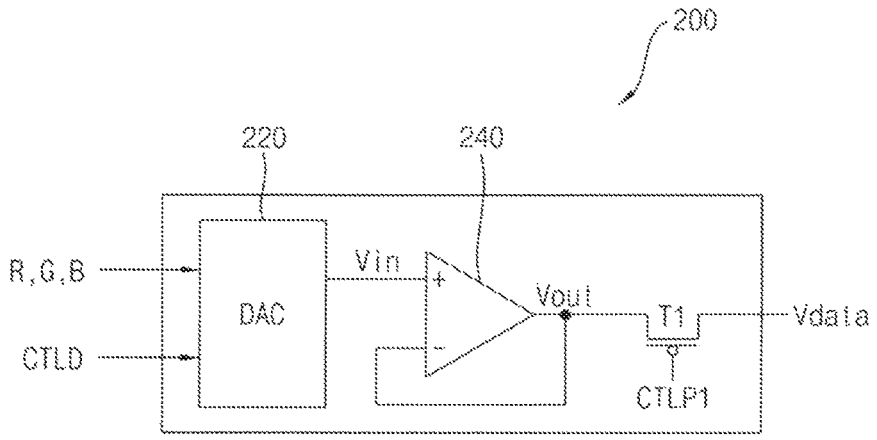
FIG. 2 is a diagram illustrating an example of a data driver included in the display device of FIG. 1.

FIG. 2 is a diagram illustrating an example of a data driver included in the display device of FIG. 1.

Referring to FIG. 2, a data driver 200 may include a digital-analog converter 220, a voltage follower 240 and a first switching transistor T1.

The digital-analog converter 220 may convert an image signal R, G, B, a digital signal, provided from the timing controller into an analog voltage based on a data control signal CTLD provided from the timing controller. The analog voltage may be provided to the voltage follower 240 coupled to the digital-analog converter 220 as an input voltage Vin.

The voltage follower 240 is an operational amplifier that includes a positive input terminal, a negative input terminal, and an output terminal. The analog voltage provided from the digital-analog converter 220 may be provided to the positive input terminal. The negative input terminal may be coupled to the output terminal. The operational amplifier may include driving voltage terminals that receive a voltage to drive the voltage follower 240, although not illustrated in FIG. 2. The voltage follower 240 is a non-inverting operational amplifier. The voltage follower 240 may have a voltage gain equal to 1. The input terminals may have the same voltage level by a virtual short effect. Thus, the voltage level of the positive input terminal and the voltage level of the negative input terminal may be the same. Further, an output voltage Vout of the non-inverting amplifier may be the same as the input voltage Vin because the negative input terminal is coupled to the output terminal. The voltage follower 240 may transmit the input signal to the output terminal as it is, although there is load impedance. Thus, the analog voltage provided from the digital-analog converter 220 may be provided to the output terminal of the voltage follower 240. The output voltage Vout of the voltage follower 240 may be provided to the first switching transistor T1 as the data signal Vdata.

The first switching transistor T1 may turn on or turn off in response to a first protection signal CTLP1. In some example embodiments, the first switching transistor T1 may be implemented as a PMOS transistor. In such cases, the first switching transistor T1 may turn on in response to the first protection signal CTLP1 having a high level. The first switching transistor T1 may turn on during the scan period. The data signal Vdata may be provided to the pixels during the scan period. When the first switching transistor T1 turns on, the data signal Vdata output from the voltage follower 240 may be provided to the pixels through the data line. The first protection signal CTLP1 may be provided from the protection circuit. The protection circuit may provide the first protection signal CTLP1 having a voltage level that turns on the first switching transistor T1 during the scan period. The protection circuit may prevent the first switching transistor T1 and the second switching transistor from simultaneously turning on by outputting the first protection signal CTLP1 and the second protection signal CTLP2.

Figure 3:
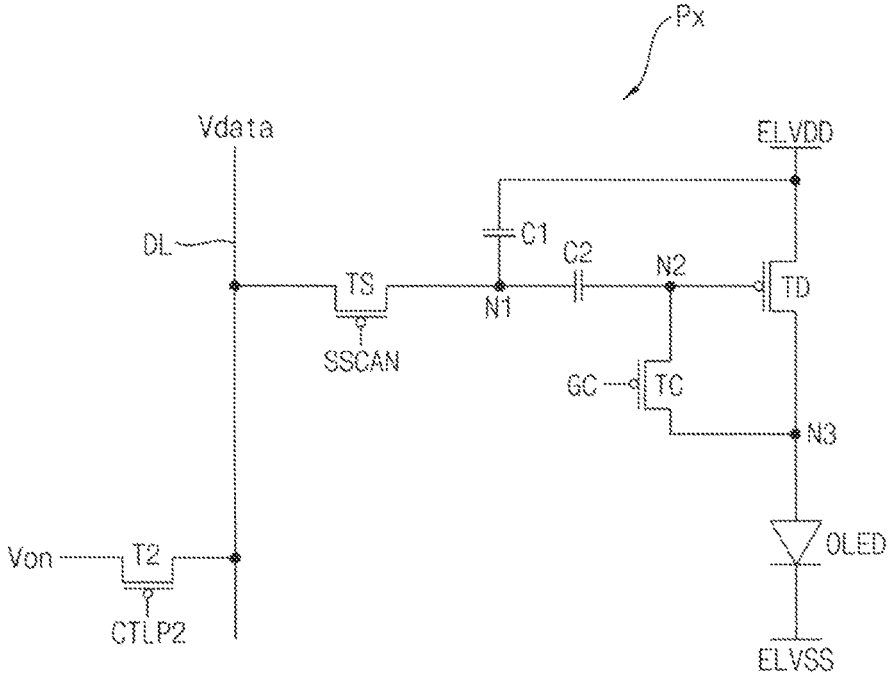
FIG. 3 is a circuit diagram illustrating an example of a pixel included in the display device of FIG. 1.

FIG. 3 is a circuit diagram illustrating an example of a pixel included in the display device of FIG. 1.

Referring to FIG. 3, the pixel may include a first capacitor C1, a scan switching transistor TS, a second capacitor C2, a driving transistor TD, a control switching transistor TC, a second switching transistor T2, and an organic light emitting diode OLED.

The scan switching transistor TS may provide a data signal Vdata to a first node N1 in response to the scan signal SSCAN. For example, the scan switching transistor TS may include a gate electrode coupled to a scan line, a source electrode coupled to a data line DL, and a drain electrode couple to the first node N1.

The first capacitor C1 may store the data signal Vdata. For example, the first capacitor C1 may have a first electrode coupled to a high power voltage line and a second electrode coupled to the first node N1.

The driving transistor TD may generate a driving current provided to the organic light emitting diode OLED based on the voltage stored in the first capacitor C1. For example, the driving transistor TD may have a gate electrode coupled to a second node N2, a source electrode coupled to a high power voltage ELVDD, and a drain electrode coupled to a third node N3.

The second capacitor C2 may charge a voltage between the first node N1 and the second node N2. For example, the second capacitor C2 may have a first electrode coupled to the first node N1 and a second electrode coupled to the second node N2.

The control switching transistor TC may couple the second node N2 and the third node N3 in response to the control signal GC. For example, the control switching transistor TC may have a gate electrode couple to a control line, a source electrode coupled to the second node N2, and a drain electrode coupled to the third node N3.

The second switching transistor T2 may provide the on-bias voltage Von to the data line DL in response to the second protection signal CTLP2. For example, the second switching transistor T2 may have a gate electrode couple to the protection circuit, a source electrode couple to the voltage generator, and a drain electrode coupled to the data line DL. The second protection signal CTLP2 may be provided from the protection circuit. The on-bias voltage Von may be provided from the voltage generator. The second switching transistor T2 may turn off while the data signal Vdata is provided to the data line DL.

The organic light emitting diode OLED may emit light in response to the driving current flowing through the driving transistor. For example, the organic light emitting diode OLED may have an anode electrode coupled to the third node N3 and a cathode electrode coupled to a low power voltage line having a low power voltage ELVSS.

Figure 4:
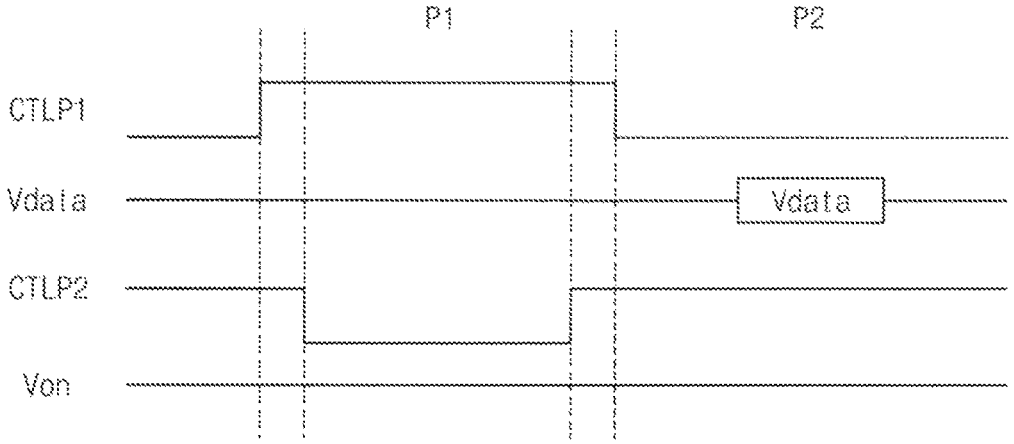
FIG. 4 is a graph illustrating for describing an operation of the display device of FIG. 1.

FIG. 4 is a graph illustrating for describing an operation of the display device of FIG. 1.

Referring to FIG. 4, the pixel may receive the on-bias voltage Von or the data signal Vdata through the data line according to the period of the pixel. For example, the second switching transistor in the pixel may turn on in response to the second protection signal CTLP2 in an initialization period P1, during which the on-bias voltage Von may be provided through the data line, and the anode electrode of the organic light emitting diode may be initialized. Further, the first switching transistor in the data driver may turn on in response to the first protection signal CTLP1 in a scan period P2, during which the data signal Vdata may be provided through the data line, and the data signal may be stored in the first capacitor. A display panel may be damaged when the first switching transistor and the second switching transistor simultaneously turn on, for example, due to a noise or a static electricity. However, according to example embodiments herein, the protection circuit prevents the first switching transistor and the second switching transistor from simultaneously turning on by converting the first control signal and the second control signal into the first protection signal CTLP1 and the second protection signal CTLP2. Thus, the damage of the display panel is prevented.

Figure 5:
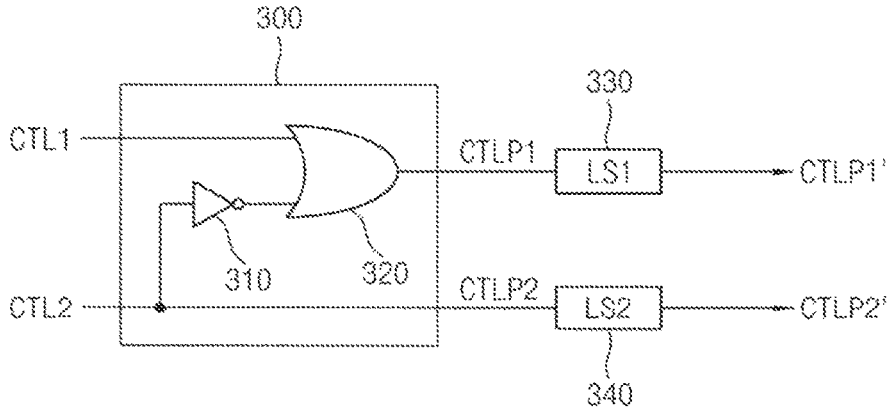
FIG. 5 is a diagram illustrating an example of a protection circuit included in the display device of FIG. 1.
Figures 6, 7:
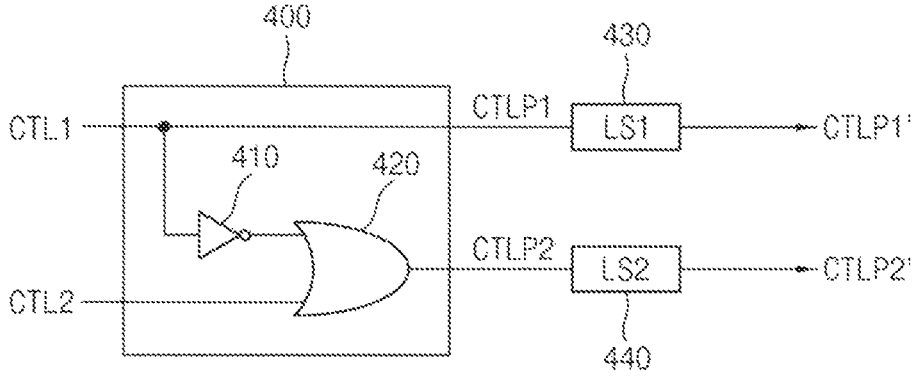
FIG. 6 is chart illustrating for describing an operation of the protection circuit of FIG. 5.
FIG. 7 is a diagram illustrating other example of a protection circuit included in the display device of FIG. 1.

FIG. 5 is a diagram illustrating an example of a protection circuit included in the display device of FIG. 1, and FIG. 6 is chart illustrating an operation of the protection circuit of FIG. 5.

Referring to FIG. 5, a protection circuit 300 may include an inverter 310 and an OR gate 320. A first control signal CTL1 provided from a timing controller may be provided to the OR gate. A second control signal CTL2 provided from the timing controller may be provided to the inverter 310 and a second level shifter 340. A polarity of the second control signal CTL2 may be changed in the inverter 310 of the protection circuit 300. For example, the inverter 310 may change a voltage level of the second control signal CTL2 having a low level to a high level. Alternately, the inverter 310 may change the voltage level of the second control signal CTL2 having the high level to the low level. The OR gate 320 may conduct a logical sum of the first control signal CTL1 and an output signal of the inverter 310. The OR gate 320 may output the logical sum of the first control signal CTL1 and the output signal of the inverter 310 as a first protection signal CTLP1. The first protection signal CTLP1 may be provided to the first level shifter 330. A voltage level of the first protection signal CTLP1 may be changed in the first level shifter 330 to turn on or turn off the first switching transistor. An output signal CTLP1' of the first level shifter 330 may be provided to the first switching transistor. If the first protection signal CTLP1 has a voltage level that turns on or turns off the first switching transistor, the first level shifter 330 may be omitted.

The second control signal CTL2 may be output as the second protection signal CTLP2 through the protection circuit 300. The second protection signal CTLP2 may be the same as the second control signal CTL2. The second protection signal CTLP2 may be provided to the second level shifter 340. A voltage level of the second protection signal CTLP2 may be changed in the second level shifter 340 to turn on or turn off the second switching transistor. An output signal CTLP2' of the second level shifter 340 may be provided to the second switching transistor. If the second protection signal CTLP2 has a voltage level that turns on or turns off the second switching transistor, the second level shifter 340 may be omitted.

A delay element that delays the second protection signal CTLP2 may be located between the protection circuit 300 and the second switching transistor, although not illustrated in FIG. 5. The delay element may delay the second protection signal CTLP2 while the first control signal CTL1 is converted to the first protection signal CTLP1 in the protection circuit 300. The protection circuit 300 may be coupled to the data driver or may be located in the data driver. Alternately, the protection circuit 300 may be located in the first level shifter 330.

The first switching transistor and the second switching transistor may be implemented as a PMOS transistor or a NMOS transistor. If the first switching transistor and the second switching transistor are implemented as the PMOS transistor, the protection circuit may be operated as illustrated in FIG. 6.

Conventionally, when the first control signal CTL1 having a low level and the second control signal CTL2 having the low level are provided from the timing controller, both of the first switching transistor and the second switching transistor turn on. Thus, the data signal and the on-bias voltage may be simultaneously provided to the pixel through the data line. In this case, the display panel may be damaged.

Referring to FIG. 6, when the first control signal CTL1 having the low level and the second control signal CTL2 having the low level are provided from the timing controller, the protection circuit 300 of FIG. 5 may change the voltage level of the first control signal CTL1. Specifically, when the first control signal CTL1 having the low level and the second control signal CTL2 having the low level are provided, the protection circuit 300 may convert the first control signal CTL1 into the first protection signal CTLP1 having the high level. The first switching transistor may turn off in response to the first protection signal CTLP1 having the high level. Here, the second control signal CTL2 may be output as the second protection signal CTLP2 having the low level. The second switching transistor may turn on in response to the second protection signal CTLP2 having the low level. Further, when neither of the first control signal CTL1 and the second control signal CTL2 has the low level, the protection circuit 300 may output the first control signal CTL1 as the first protection control signal CTLP1 as it is and may output the second control signal CTL2 as the second protection control signal CTLP2 as it is.

Figures 8, 9:
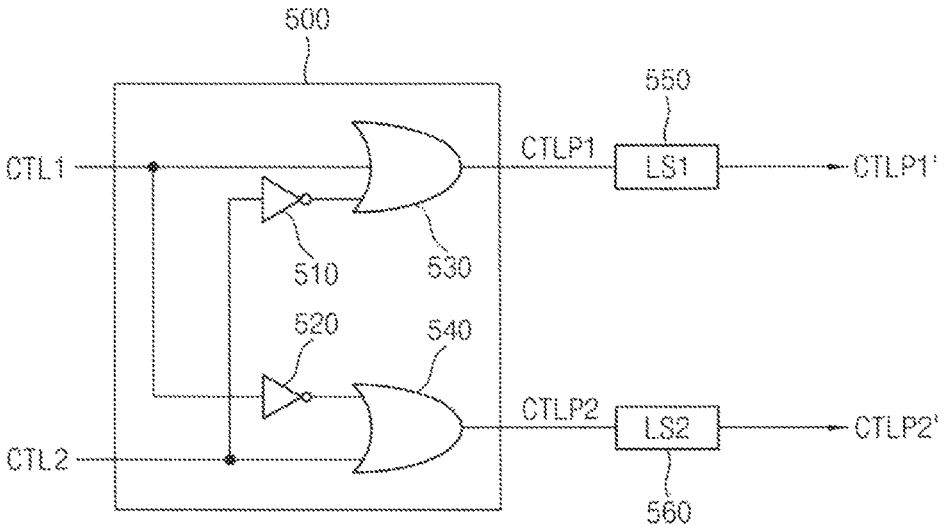
FIG. 8 is a chart illustrating for describing an operation of the protection circuit of FIG. 7.
FIG. 9 is a diagram illustrating other example of a protection circuit included in the display device of FIG. 1.

FIG. 7 is a diagram illustrating other example of a protection circuit included in the display device of FIG. 1, and FIG. 8 is a chart illustrating an operation of the protection circuit of FIG. 7.

Referring to FIG. 7, a protection circuit 400 may include an inverter 410 and an OR gate 420. A first control signal CTL1 provided from a timing controller may be provided to a first level shifter 430 and the inverter 410. A second control signal CTL2 provided from the timing controller may be provided to the OR gate 420. The first control signal CTL1 may be output as the second protection signal CTLP2 through the protection circuit 400. The first protection signal CTLP1 may be the same as the first control signal CTL1. The first protection signal CTLP1 may be provided to the first level shifter 430. A voltage level of the first protection signal CTLP1 may be changed in the first level shifter 430 to turn on or turn off the first switching transistor. An output signal CTLP1' of the first level shifter 430 may be provided to the first switching transistor. If the first protection signal CTLP1 has a voltage level that turns on or turns off the first switching transistor, the first level shifter 430 may be omitted.

A polarity of the first control signal CTL1 may be changed in the inverter 410 of the protection circuit 400. For example, the inverter 410 may change a voltage level of the first control signal CTL1 having a low level to a high level. Alternately, the inverter 410 may change the voltage level of the first control signal CTL1 having the high level to the low level. The OR gate 420 may conduct a logical sum of an output signal of the inverter 410 and the second control signal CTL2. The OR gate 420 may output the logical sum of the output signal of the inverter 410 and the second control signal CTL2 as a second protection signal CTLP2. A voltage level of the second protection signal CTLP2 may be changed in the second level shifter 440 to turn on or turn off the second switching transistor. An output signal CTLP2' of the second level shifter 440 may be provided to the second switching transistor. If the second protection signal CTLP2 has a voltage level that turns on or turns off the second switching transistor, the second level shifter 440 may be omitted.

A delay element that delays the first protection signal CTLP1 may be located between the protection circuit 400 and the first switching transistor, although not illustrated in FIG. 7. The delay element may delay the first protection signal CTLP1 while the second control signal CTL2 is converted to the second protection signal CTLP2 in the protection circuit 400. The protection circuit 400 may be coupled to the data driver or may be located in the data driver. Alternately, the protection circuit 400 may be located in the second level shifter 440.

The first switching transistor and the second switching transistor may be implemented as a PMOS transistor or a NMOS transistor. If the first switching transistor and the second switching transistor are implemented as the PMOS transistor, the protection circuit may be operated as illustrated in FIG. 8.

Conventionally, when the first control signal CTL1 having a low level and the second control signal CTL2 having the low level are provided from the timing controller, both of the first switching transistor and the second switching transistor turn on. Thus, the data signal and the on-bias voltage may be simultaneously provided to the pixel through the data line. In this case, the display panel may be damaged.

Referring to FIG. 8, when the first control signal CTL1 having the low level and the second control signal CTL2 having the low level are provided from the timing controller, the protection circuit 400 of FIG. 7 may change the voltage level of the second control signal CTL2. Specifically, when the first control signal CTL1 having the low level and the second control signal CTL2 having the low level are provided, the protection circuit 400 may convert the second control signal CTL2 into the second protection signal CTLP2 having the high level. The second switching transistor may turn off in response to the second protection signal CTLP2 having the high level. Here, the first control signal CTL1 may output as the first protection signal CTLP1 having the low level. The first switching transistor may turn on in response to the first protection signal CTLP1 having the low level. Further, when neither of the first control signal CTL1 and the second control signal CTL2 has the low level, the protection circuit 400 may output the first control signal CTL1 as the first protection control signal CTLP1 as it is and may output the second control signal CTL2 as the second protection control signal CTLP2 as it is.

Figures 10, 11:
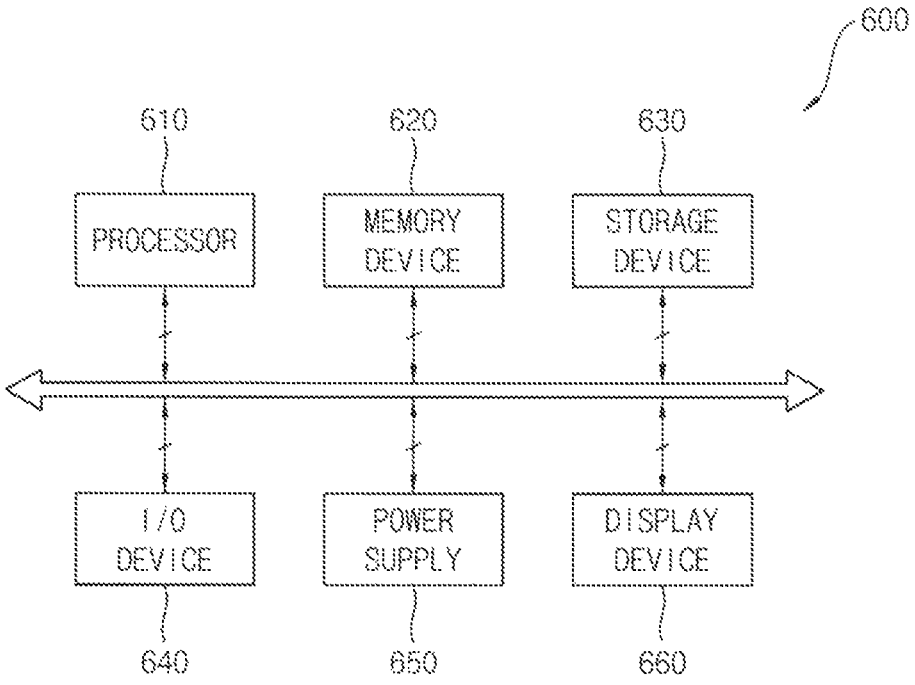
FIG. 10 is a chart illustrating for describing an operation of the protection circuit of FIG. 9.
FIG. 11 is a block diagram illustrating an electronic device according to example embodiments.

FIG. 9 is a diagram illustrating other example of a protection circuit included in the display device of FIG. 1, and FIG. 10 is a chart illustrating for describing an operation of the protection circuit of FIG. 9.

Referring to FIG. 9, a protection circuit 500 may include a first inverter 510, a second inverter 520, a first OR gate 530 and a second OR gate 540. The first control signal CTL1 provided from a timing controller may be provided to the first OR gate 530 and the second inverter 520. The second control signal CTL2 provided from the timing controller may be provided to the second OR gate 540 and the first inverter 510. A polarity of the first control signal CTL1 may be changed in the second inverter 520. For example, the second inverter 520 may change a voltage level of the first control signal CTL1 having a low level to a high level. Alternately, the second inverter 520 may change the voltage level of the first control signal CTL1 having the high level to the low level. The second OR gate 540 may conduct a logical sum of an output signal of the second inverter 520 and the second control signal CTL2. The second OR gate 540 may output the logical sum of the output signal of the second inverter 520 and the second control signal CTL2 as a second protection signal CTLP2. The protection signal CTLP2 may be provided to the second level shifter 560. A voltage level of the second protection signal CTLP2 may be changed in the second level shifter 560 to turn on or turn off the second switching transistor. An output signal CTLP2' of the second level shifter 560 may be provided to the second switching transistor. If the second protection signal CTLP2 has a voltage level that turns on or turns off the second switching transistor, the second level shifter 560 may be omitted.

A polarity of the second control signal CTL2 may be changed in the first inverter 510 of the protection circuit 500. For example, the first inverter 510 may change a voltage level of the second control signal CTL2 having a low level to a high level. Alternately, the first inverter 510 may change the voltage level of the second control signal CTL2 having the high level to the low level. The first OR gate 530 may conduct a logical sum of an output of the first inverter 510 and the first control signal CTL1. The first OR gate 530 may output the logical sum of the output signal of the first inverter 510 and the first control signal CTL1 as a first protection signal CTLP1. A voltage level of the first protection signal CTLP1 may be changed in the first level shifter 550 to turn on or turn off the first switching transistor. An output signal CTLP1' of the first level shifter 550 may be provided to the first switching transistor. If the first protection signal CTLP1 has a voltage level that turns on or turns off the first switching transistor, the first level shifter 550 may be omitted.

The first switching transistor and the second switching transistor may be implemented as a PMOS transistor or a NMOS transistor. If the first switching transistor and the second switching transistor are implemented as the PMOS transistor, the protection circuit may be operated as illustrated in FIG. 10.

Conventionally, when the first control signal CTL1 having a low level and the second control signal CTL2 having the low level are provided from the timing controller, both of the first switching transistor and the second switching transistor turn on. Thus, the data signal and the on-bias voltage may be simultaneously provided to the pixel through the data line. In this case, the display panel may be damaged.

Referring to FIG. 10, when the first control signal CTL1 having the low level and the second control signal CTL2 having the low level are provided from the timing controller, the protection circuit 500 of FIG. 9 may change the voltage level of the first control signal CTL1 and the voltage level of the second control signal CTL2. Specifically, when the first control signal CTL1 having the low level and the second control signal CTL2 having the low level is provided, the protection circuit 500 may convert the first control signal CTL1 into the first protection signal CTLP1 having the high level and may convert the second control signal CTL2 into the second protection signal CTLP2 having the high level. The first switching transistor may turn off in response to the first protection signal CTLP1 having the high level. The second switching transistor may turn off in response to the second protection signal CTLP2 having the high level. Further, when neither of the first control signal CTL1 and the second control signal CTL2 has the low level, the protection circuit 500 may output the first control signal CTL1 as the first protection control signal CTLP1 as it is and may output the second control signal CTL2 as the second protection control signal CTLP2 as it is.

Figure 12:
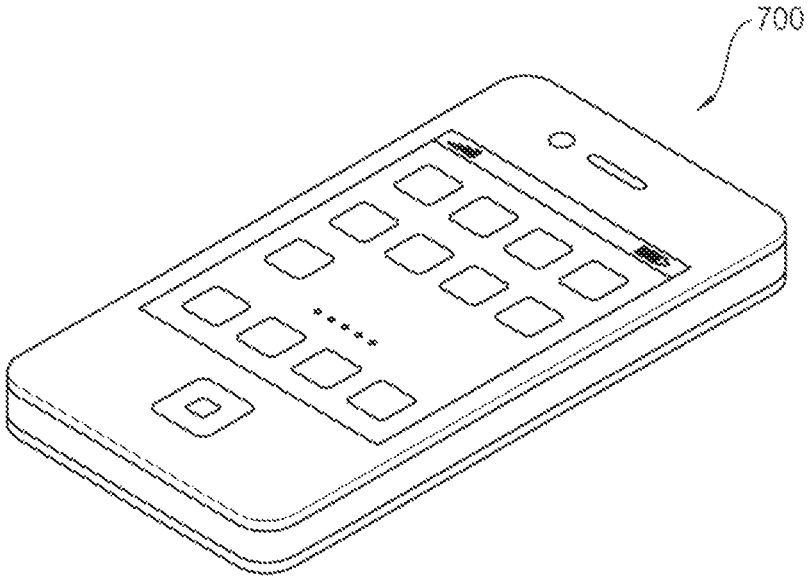
FIG. 12 is a diagram illustrating an example embodiment in which the electronic device of FIG. 11 is implemented as a smart phone.

FIG. 11 is a block diagram illustrating an electronic device according to example embodiments, and FIG. 12 is a diagram illustrating an example embodiment in which the electronic device of FIG. 11 is implemented as a smart phone.

Referring to FIGS. 11 and 12, an electronic device 600 may include a processor 610, a memory device 620, a storage device 630, an input/output (I/O) device 640, a power device 650, and a display device 660. Here, the display device 660 may correspond to the display device 100 of FIG. 1. In addition, the electronic device 600 may further include a plurality of ports for communicating with a video card, a sound card, a memory card, a universal serial bus (USB) device, other electronic device, etc. Although it is illustrated in FIG. 12 that the electronic device 600 is implemented as a smart phone 700, the type of the electronic device 600 is not limited thereto.

The processor 610 may perform various computing functions. The processor 610 may be a micro processor, a central processing unit (CPU), etc. The processor 610 may be coupled to other components via an address bus, a control bus, a data bus, etc. Further, the processor 610 may be coupled to an extended bus such as surrounded component interconnect (PCI) bus. The memory device 620 may store data for operations of the electronic device 400. For example, the memory device 620 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 630 may be a solid stage drive (SSD) device, a hard disk drive (HDD) device, a CD-ROM device, etc.

The I/O device 640 may be an input device such as a keyboard, a keypad, a touchpad, a touch-screen, a mouse, etc, and an output device such as a printer, a speaker, etc. In some example embodiments, the display device 660 may be included in the I/O device 640. The power device 650 may provide a power for operations of the electronic device 400. The display device 660 may communicate with other components via the buses or other communication links. As described above, the display device 660 may include a display panel, a scan driver, a data driver, a voltage generator, a timing controller, and a protection circuit. A plurality of scan lines and a plurality of data lines may be formed on the display panel. A plurality of pixels may be formed in intersection regions of the scan lines and the data lines. Each of the pixels may receive a data signal or an on-bias voltage through the data line according to an operation period of the pixel. The data driver may include a first switching transistor that turns on or turns off in response to a first protection signal provided from the protection circuit. The first switching transistor in the data driver may turn on and the data signal may be provided to the pixel through the data line during a scan period. Each of the pixels may include a second switching transistor that turns on or turns off in response to a second protection signal provided from the protection circuit. The second switching transistor may turn on and the on-bias voltage may be provided to the pixel through the data line during an on-bias period. The protection circuit may receive a first control signal and a second control signal from the timing controller. The protection circuit may convert the first control signal into a first protection signal and may convert the second control signal into a second protection signal. The protection signal may convert one of the first control signal and the second control signal in cases in which the first control signal and the second control signal would simultaneously turn on the first switching transistor of the data driver and the second switching transistor of the pixel. That is, the protection circuit may prevent an overlapping output of the data signal and the on-bias voltage by converting the first control signal to the first protection signal and/or the second control signal to the second protection signal. In some example embodiments, the protection circuit may include an inverter that inverts the second control signal and an OR gate that conducts a logical sum of the first control signal and an output signal of the inverter. Here, the protection circuit may further include a delay element that delays the first protection signal. In other example embodiments, the protection circuit may include an inverter that inverts the first control signal and an OR gate that conducts a logical sum of an output signal of the inverter and the second control signal. Here, the protection circuit may include a delay element that delays the second protection signal. In other example embodiments, the protection circuit may include a first inverter that inverts the first control signal, a second inverter that inverts the second control signal, a first OR gate that conducts a logical sum of the first control signal and an output signal of the first inverter, and a second OR gate that conducts a logical sum of the second control signal and an output signal of the second inverter.

As described above, the electronic device 600 may include the display device 660 including the protection circuit that prevents the overlapping output of the data signal and the on-bias voltage. The protection circuit may prevent the first switching transistor and the second switching transistor from simultaneously turning on by converting the first control signal and the second control signal into the first protection signal and the second protection signal. Thus, a damage of the display panel due to simultaneously providing of the on-bias voltage and the data signal may be prevented.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art would readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device comprising:

a display panel including a plurality of data lines, a plurality of scan lines, and a plurality of pixels;

a scan driver configured to provide a scan signal to the pixels through the scan lines;

a data driver configured to provide a data signal to the pixels through the data lines;

a voltage generator configured to provide an on-bias voltage to the pixels through the data lines;

a timing controller configured to generate a first control signal that controls the data driver and a second control signal that controls the voltage generator; and a protection circuit configured to generate a first protection signal and a second protection signal by converting the first control signal and the second control signal from the timing controller using a logic circuit, output the first protection signal to a first switching transistor in the data driver that provides the data signal, and output the second protection signal to a second switching transistor in the pixel that receives the on-bias voltage from the voltage generator, wherein the protection circuit prevents an overlapping output of the data signal and the on-bias voltage when the first control signal and the second control signal that are the same are provided from the timing controller by outputting the first protection signal and the second protection signal.

2. The display device of claim 1, wherein the data driver includes a first switching transistor that turns on or turns off in response to the first protection signal.

3. The display device of claim 1, wherein the pixel includes a second switching transistor that turns on or turns off in response to the second protection signal.

4. The display device of claim 1, wherein the protection circuit includes:

an inverter configured to invert the second control signal; and an OR gate configured to implement a logical sum of the first control signal and an output signal of the inverter.

5. The display device of claim 1, wherein the protection circuit includes:

an inverter configured to invert the first control signal; and an OR gate configured to implement a logic sum of an output signal of the inverter and the second control signal.

6. The display device of claim 1, wherein the protection circuit includes:

a first inverter configured to invert the second control signal;

a second inverter configured to invert the first control signal;

a first OR gate configured to implement a logical sum of the first control signal and an output signal of the first inverter; and a second OR gate configured to implement a logical sum of the second control signal and an output signal of the second inverter.

7. The display device of claim 1, further comprising:

a first level shifter configured to amplify the first protection signal; and a second level shifter configured to amplify the second protection signal.

8. The display device of claim 7, wherein the protection circuit is included in the first level shifter or the second level shifter.

9. The display device of claim 1, wherein the protection circuit is included in the data driver.

10. The display device of claim 1, wherein the protection circuit further includes a delay element that delays the first protection signal or the second protection signal.

11. An electronic device includes a display device and a processor that controls the display device, wherein the display device comprising:

a display panel including a plurality of data lines, a plurality of scan lines, and a plurality of pixels;

a scan driver configured to provide a scan signal to the pixels through the scan lines;

a data driver configured to provide a data signal to the pixels through the data lines;

a voltage generator configured to provide an on-bias voltage to the pixels through the data lines;

a timing controller configured to generate a first control signal that controls the data driver and a second control signal that controls the voltage generator; and a protection circuit configured to generate a first protection signal and a second protection signal by converting the first control signal and the second control signal from the timing controller using a logic circuit, output the first protection signal to a first switching transistor in the data driver that provides the data signal, and output the second protection signal to a second switching transistor in the pixel that receives the on-bias voltage from the voltage generator, wherein the protection circuit prevents an overlapping output of the data signal and the on-bias voltage when the first control signal and the second control signal that are the same are provided from the timing controller by outputting the first protection signal and the second protection signal.

12. The electronic device of claim 11, wherein the data driver includes a first switching transistor that turns on or turns off in response to the first protection signal.

13. The electronic device of claim 11, wherein the pixel includes a second switching transistor that turns on or turns off in response to the second protection signal.

14. The electronic device of claim 11, wherein the protection circuit includes:

an inverter configured to invert the second control signal; and an OR gate configured to implement a logic sum of the first control signal and an output signal of the inverter.

15. The electronic device of claim 11, wherein the protection circuit includes:

an inverter configured to invert the first control signal; and an OR gate configured to implement a logic sum of an output signal of the inverter and the second control signal.

16. The electronic device of claim 11, wherein the protection circuit includes:

a first inverter configured to invert the second control signal;

a second-inverter configured to invert the first control signal;

a first OR gate configured to implement a logic sum of the first control signal and an output signal of the first inverter; and a second-OR gate configured to implement a logic sum of the second control signal and an output signal of the second inverter.

17. The electronic device of claim 11, further comprising:

a first level shifter configured to amplify the first protection signal; and a second level shifter configured to amplify the second protection signal.

18. The electronic device of claim 17, wherein the protection circuit is included in the first level shifter or the second level shifter.

19. The electronic device of claim 11, wherein the protection circuit is included in the data driver.

20. The electronic device of claim 11, wherein the protection circuit further include a delay element that delays the first protection signal or the second protection signal.

* * * * *